US008620185B2

(12) United States Patent
Kinokuni

(10) Patent No.: US 8,620,185 B2
(45) Date of Patent: Dec. 31, 2013

(54) IMAGE FORMING APPARATUS FEATURING PHASE RELATIONSHIP ADJUSTMENT BETWEEN IMAGE BEARING MEMBERS

(75) Inventor: Jiro Kinokuni, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 52 days.

(21) Appl. No.: 12/948,998

(22) Filed: Nov. 18, 2010

(65) Prior Publication Data

US 2011/0129255 A1 Jun. 2, 2011

(30) Foreign Application Priority Data

Dec. 1, 2009 (JP) ..... 2009-273188

(51) Int. Cl.
*G03G 15/00* (2006.01)

(52) U.S. Cl.
USPC ..... 399/167

(58) Field of Classification Search
USPC ..... 399/167, 301; 347/116
See application file for complete search history.

(56) References Cited

U.S. PATENT DOCUMENTS 6,173,141 B1 1/2001 Sakagami et al.

FOREIGN PATENT DOCUMENTS

| | | | | |
|---|---|---|---|---|
| EP | 999479 A2 * | 5/2000 | ..... | G03G 15/01 |
| JP | 2005017768 A * | 1/2005 | ..... | G03G 15/01 |
| JP | 2008-76546 A | 4/2008 | | |

* cited by examiner

*Primary Examiner* — Billy J Lactaoen
(74) *Attorney, Agent, or Firm* — Fitzpatrick, Cella, Harper & Scinto

(57) ABSTRACT

A phase synchronization mode is performed at a time of subsequent rotation after image formation. After detection of a phase difference by phase detecting sensors 103*a*, 103*d*, rotation phases are synchronized between driving motors 111, 102*d* after a lapse of a variable time. Specifically, timing for starting the rotation phase synchronization is shifted by 20 msec for each phase synchronization control so as to vary angular positions of the photosensitive drums 101*a*, 101*b*, 101*d* at which phase control is started. In this manner, sliding-contact positions are distributed and development and concentration of sliding-contact damages are prevented on the photosensitive drums 101*a*, 101*b*, 101*d*.

11 Claims, 10 Drawing Sheets

ROTATION PHASE OUT OF SYNC STATE

ROTATION PHASE IN SYNC STATE

PLAN VIEW

FRONT VIEW

DISTRIBUTION IN DETECTED ROTATION PHASE DIFFERENCE

DISTRIBUTION IN DETECTED TIME DIFFERENCE

CASE OF NOT PERFORMING SHIFT CONTROL

CASE OF PERFORMING SHIFT CONTROL

IMAGE FORMING APPARATUS FEATURING PHASE RELATIONSHIP ADJUSTMENT BETWEEN IMAGE BEARING MEMBERS

BACKGROUND OF THE INVENTION

1. Field of the Invention

The present invention relates to an image forming apparatus having a plurality of image bearing members disposed along an intermediate transfer member or a recording material conveying member, and more particularly to control of adjusting a rotation phase positions between the two image bearing members with different driving motors.

2. Description of the Related Art

A tandem-type multi-color image forming apparatus has been widely used, in which image forming portions provided with developing colors of cyan, magenta, yellow, and black are disposed along the intermediate transfer member or the recording material conveying member (rotating member).

In some of the tandem-type image forming apparatus, referring to FIG. 1, an image forming portion Pd for black and an intermediate transfer belt (104) are driven by a common driving motor (102*d*) while the other image forming portions (Pa, Pb, Pc) for the other colors are driven by the other driving motor (111). This is because the image forming portions (Pa, Pb, Pc) for yellow, magenta, and cyan can be easily stopped when performing a black monochrome mode in which monochrome images are formed using only the image forming portion Pd for black (U.S. Pat. No. 6,173,141).

However, in order to reduce a color deviation in respective colors in a full color image, it is preferable that photosensitive drums (101*a*, 101*b*, 101*c*, 101*d*) for respective colors equally reproduce the rotation phase each time of image formation. In this case, the three photosensitive drums (101*a*, 101*b*, 101*c*) have rotation phases aligned by the common driving system, so that synchronization is required in a rotation phase between these drums and the photosensitive drum (101*d*) for black which has an independent driving system.

U.S. Pat. No. 6,173,141 discloses such a tandem-type multi-color image forming apparatus that an image bearing member for black and a recording material conveying belt are driven by a driving system which is independent from a driving system for image bearing members for cyan, magenta, and yellow. Herein, speed fluctuations are detected in the image bearing members for cyan, magenta, and yellow and in the image bearing member for black, and the image bearing members for cyan, magenta, and yellow keep synchronizing their rotation phases so that phases of the speed fluctuations are aligned between the image bearing members for cyan, magenta, and yellow and the image bearing member for black.

In a case of using a motor by which a rotation phase is controlled with high accuracy at a time of gathering speed at start-up and reducing speed at shutdown, unlike the image forming apparatus disclosed in U.S. Pat. No. 6,173,141, it is not necessary to keep synchronizing rotation phases during operation. The rotation phases may be synchronized between two driving systems at an image formation interval between prior rotation before image formation, subsequent rotation, and detection of a significant deviation between rotation phases. Rotation is stabilized during image formation by synchronizing rotation phases at once at a time of image non-formation, thereby preventing occurrence of color derivation resulting from control of synchronizing the rotation phases.

However, in a case of performing control of synchronizing the rotation phases of the image bearing member for black and the image bearing members for the other colors at once, friction is caused between the image bearing members for the other colors and the rotating member with a velocity difference in association with the control of synchronizing the rotation phase. In a case where phase synchronization is always repeated at approximately the same phase positions in the image bearing members for the other colors, friction may proceed or many sliding-contact damages may be caused at the specific positions on the periphery of the image bearing members for cyan, magenta, and yellow. Therefore, variations in concentration or image damages appear prominently in a biased manner at one part of the output image, thereby deteriorating an image quality at an early stage in life of the image bearing members.

SUMMARY OF THE INVENTION

The present invention provides an image forming apparatus which can restrain friction from being concentrated on the specific position of the image bearing member.

The present invention has a typical configuration as described below. An image forming apparatus includes a first image bearing member; a second image bearing member; a rotating member which is rotated by coming in contact with the first image bearing member and the second image bearing member; a first driving motor which transmits a driving force to the first image bearing member; a second driving motor which transmits the driving force to the second image bearing member; a detecting unit which is capable of detecting a phase relationship of rotation of the second image bearing member with respect to rotation of the first image bearing member; a adjusting unit which adjusts the phase relationship between the first image bearing member and the second image bearing member by changing a traveling speed of at least the first image bearing member or the second image bearing member so as to set the phase relationship between the first image bearing member and the second image bearing member to a predetermined phase relationship; and a changing unit which changes timing predetermined timing with respect to timing for changing the traveling speed of at least the first image bearing member or the second image bearing member, based on a detection result of the detecting unit.

Further features of the present invention will become apparent from the following description of exemplary embodiments with reference to the attached drawings.

DESCRIPTION OF THE EMBODIMENTS

In the following, embodiments of the present invention will be described in detail manner with reference to the drawings. As long as every phase synchronization control is performed at positions distributed on the periphery of the photosensitive drums, the present invention can be carried out with another embodiment achieved by replacing part or all of this embodiment with an alternative configuration.

Therefore, with any tandem type provided with two or more image bearing members, regardless of a developing system, a charging system, or an electrostatic image forming system, and regardless of the number of image forming portions, the present invention can be carried out regardless of an intermediate transfer system or a recording material conveying system.

This embodiment describes only the essential parts which are related to formation and transfer of a toner image. However, the present invention may be carried out for various applications such as a printer, various printing machines, a copying machine, and a fax machine, by adding necessary devices, equipment, and a housing configuration.

It is noted that duplicate description will not be repeated by omitting illustration for general matters concerning the image forming apparatus disclosed in U.S. Pat. No. 6,173,141.

<Image Forming Apparatus>

Figure 1:
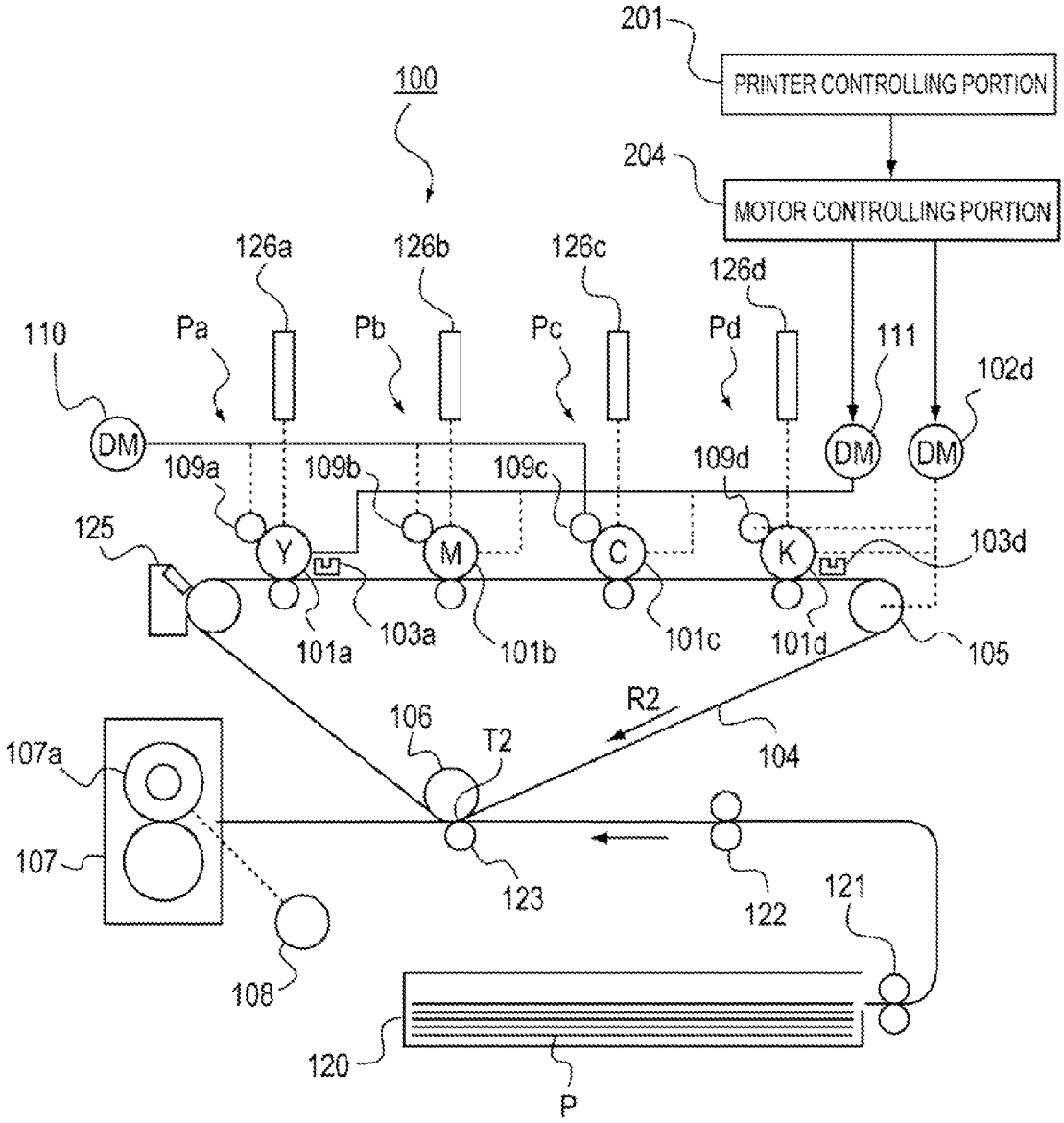
FIG. 1 is a view illustrating a configuration of an image forming apparatus.
Figure 2:
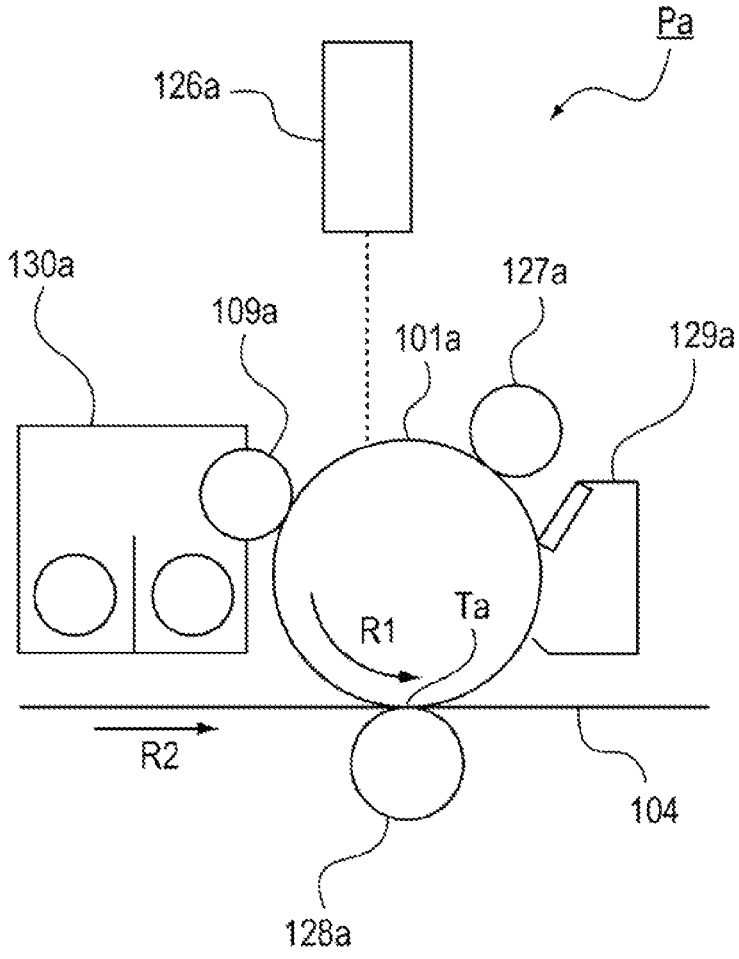
FIG. 2 is a view illustrating a configuration of an image forming portion for yellow.

FIG. 1 is a view illustrating a configuration of an image forming apparatus. FIG. 2 is a view illustrating a configuration of an image forming portion for yellow. FIG. 3 is a view illustrating rotation variations of photosensitive drums.

As shown in FIG. 1, an image forming apparatus 100 is a tandem-type multi-color printer of a intermediate transfer system in which image forming portions Pa, Pb, Pc, Pd for yellow, magenta, cyan, and black are arranged along an intermediate transfer belt 104.

With the image forming portion Pa, a yellow toner image is formed on a photosensitive drum 101*a*, thereby being primarily transferred to the intermediate transfer belt 104. With the image forming portion Pb, a magenta toner image is formed on a photosensitive drum 101*b*, thereby being overlaid on the yellow toner image on the intermediate transfer belt 104 so as to be primarily transferred. With the image forming portions Pc, Pd, a cyan toner image and a black toner image are formed on photosensitive drums 101*c*, 101*d*, respectively, thereby being sequentially overlaid on the intermediate transfer belt 104 in the same manner so as to be primarily transferred.

These toner images in four colors which have been primarily transferred to the intermediate belt 104 are conveyed to a secondary transfer portion T2, thereby being secondarily transferred at once to a recording material P. The recording materials P drawn out of a recording material cassette 120 are separated by a separation roller 121 one by one, thereby being fed to a registration roller 122. The registration roller 122 receives the recording material P and puts it on standby in a stopped state, thereby feeding the recording material P to the secondary transfer portion T2 by synchronizing timing for the toner images on the intermediate transfer belt 104.

The recording material P to which the toner images in four colors have been secondarily transferred are subjected to heat and pressure by a fixing device 107 to fix the toner images on the surface, thereby being ejected to the exterior of the apparatus.

The intermediate transfer belt 104 as an example of a rotating member passes over so as to be supported by a tension roller 124, a driving roller 105, and a counter roller 106. The intermediate transfer belt 104 is driven by the driving roller 105 to rotate in direction of an arrow R2 at a processing speed of 140 mm/sec. The secondary transfer roller 123 abuts on the intermediate transfer belt 104 to form the secondary transfer portion T2, in which the intermediate transfer belt 104 has an inner surface supported by the counter roller 106. The counter roller 106 is connected to ground potential, and the toner images borne by the intermediate transfer belt 104 are secondarily transferred to the recording material P upon application of direct current to the secondary transfer roller 123. A belt cleaning device 125 slides a cleaning blade in contact with the intermediate transfer belt 104 so as to collect transfer-remaining toner which has been excluded from the transfer to the recording material P, passed through the secondary transfer portion T2, and remains at the intermediate transfer belt 104.

The image forming portions Pa, Pb, Pc, Pd are formed in a substantially identical manner except that toner colors used in respective developing devices are different from each other, i.e., yellow, magenta, cyan, and black. Hereinafter, the image forming portion Pa is described with reference to FIG. 2 while the image formation portions Pb, Pc, Pd are described supposing that constituent elements of the image forming portion Pa are assigned with the last characters b, c, d, instead of a.

As shown in FIG. 2, the image forming portion Pa is configured so that a charging roller 127*a*, an exposing device 126*a*, a developing device 130*a*, a primary transfer roller 128*a*, a cleaning device 129*a* are disposed around the photosensitive drum 101 as an example of a first image bearing member. The photosensitive drum 101*a* is provided with a photosensitive layer of a negative charge polarity on an outer circumference of an aluminum cylinder and rotates in a direction of an arrow R1 at a processing speed of 140 mm/sec.

The charging roller 127*a* abuts on the photosensitive drum 101*a* and is driven to rotate. The charging roller 127*a* uniformly charges a surface of the photosensitive drum 101*a* to a negative dark-area potential VD upon application of an oscillating voltage in which alternating current is superimposed on direct current. The exposing device 126*a* scans with a rotation mirror a laser beam obtained by on-off-keying applied to a scanning line image data in which yellow-color image is developed, and writes an electrostatic image of an image on a surface of the charged photosensitive drum 101*a*. The developing device 130*a* charges a two-component developer and causes a developing sleeve 109*a* to bear it in a carrier chain formation state, thereby reversely developing an electrostatic image by sliding the photosensitive drum 101*a* in a contact manner using the tip of the two-component developer.

The primary transfer roller 128*a* presses an inner side face of the intermediate transfer belt 104 so that a primary transfer portion Ta is formed between the photosensitive drum 101*a* and the intermediate transfer belt 104. Upon application of positive direct current to the primary transfer roller 128*a*, the toner image borne by the photosensitive drum 101*a* is primarily transferred to the intermediate transfer belt 104 which passes through the primary transfer portion Ta. The cleaning device 129*a* slides the cleaning blade in contact with the photosensitive drum 101*a* to collect transfer-remaining toner which has been excluded from the transfer to the intermediate transfer belt 104 and remains at the photosensitive drum 101*a*.

Recently, an electrophotographic type image forming apparatus (such as a copying machine, a printer, and a fax machine) has been quickly shifted from a monochrome machine to a multi-color machine. The multi-color image forming apparatus is broadly divided into two types, i.e., one-drum type and a tandem type.

The one-drum type is provided with developing devices for multiple colors around a single image bearing member, in which toner images in the respective colors developed by the respective developing devices are superimposed on the intermediate transfer member to form a merged toner image, thereby transferring the merged toner image to the recording material to record a multi-color image. On the other hand, the tandem type is provided with a plurality of image bearing members placed in a line to simultaneously form in parallel thereon a plurality of toner images each having a single color. The toner images each in a single color are sequentially transferred and superimposed on the intermediate transfer member to form a merged toner image, and the merged toner image is transferred to the recording material to record a multi-color image.

When making a comparison between the one-drum type and the tandem type, since the one-drum type is provided with a single image bearing member, the overall configuration can be made smaller compared with the tandem type, leading to such an advantage that a small number of components keep costs low. However, the one-drum type is not suitable to speed up image formation because a single multi-color image is formed by rotating the single image bearing member multiple times. On the other hand, the tandem type is inferior to the one-drum type in size and cost but is suitable for the speed-up because toner images in respective colors are formed independently of each other and a merged toner image is formed by one pass, thereby achieving an image formation speed as high as that of formation of a monochrome image. Therefore, the image forming apparatus 100 adopts a configuration of the tandem type.

However, compared with the one-drum type, the tandem-type image forming apparatus, because of its configuration, easily causes misalignment of positions at which toner images in respective colors are formed, and this misalignment appears as color deviation in an image, thereby deteriorating the image quality of an output image. The photosensitive drum has rotation variation periodically caused due to, e.g., shift of a rotation axis, distortion of a resin-molded gear, a total profile error, and decentering, thereby causing a periodic variation in speed of the intermediate transfer belt. Thus, as shown in FIG. 3, so-called AC color deviation easily occurs, in which the rotation speed of the photosensitive drum is periodically varied, thereby changing the amount of color deviation on the intermediate transfer belt.

<Driving Configuration and AC Color Deviation>

As shown in FIG. 1, the image forming apparatus 100 is configured so that the photosensitive drums 101*a*, 101*b*, 101*c* as an example of a first image bearing member and the photosensitive drum 101*d* as an example of a second image bearing member are rotated by coming in contact with the intermediate transfer belt 104 as an example of a rotating member. The photosensitive drums 101*a*, 101*b*, 101*c* as an example of the first image bearing member are driven by a first driving motor 111 while the photosensitive drum 101*d* as an example of the second image bearing member and the intermediate transfer belt 104 are driven by an independent second driving motor 102*d*.

Figure 3A:
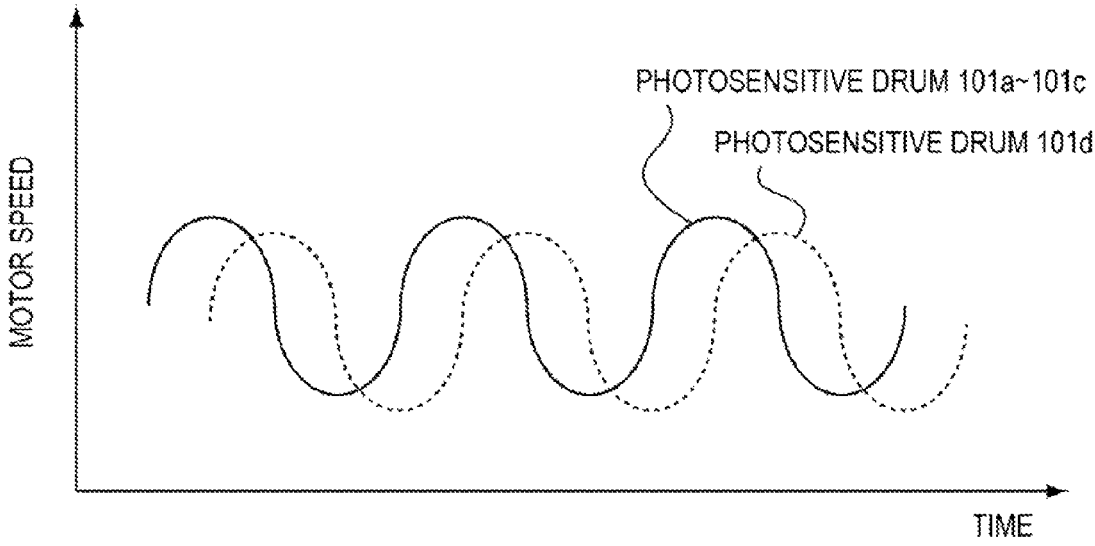
FIGS. 3A and 3B are views illustrating rotation variations of photosensitive drums.

The driving motors 111, 102*d* are precisely controlled with respect to rise and fall of the rotation so as to prevent unnecessary friction between the photosensitive drums 101*a*, 101*b*, 101*c* and the intermediate transfer belt 104 at a time of gathering speed at start-up or reducing speed at shutdown. Thus, no significant deviation occurs between rotation phases in the photosensitive drums 101*a*, 101*b*, 101*c* and the photosensitive drum 101*d* by one start-up and shutdown. However, in a case where start-up and shutdown are repeated, deviations between the phases in the photosensitive drums 101*a*, 101*b*, 101*c* and the photosensitive drum 101*d* are accumulated, so that the extremely significant AC color deviation possibly occurs as shown in FIG. 3A.

Figure 3B:
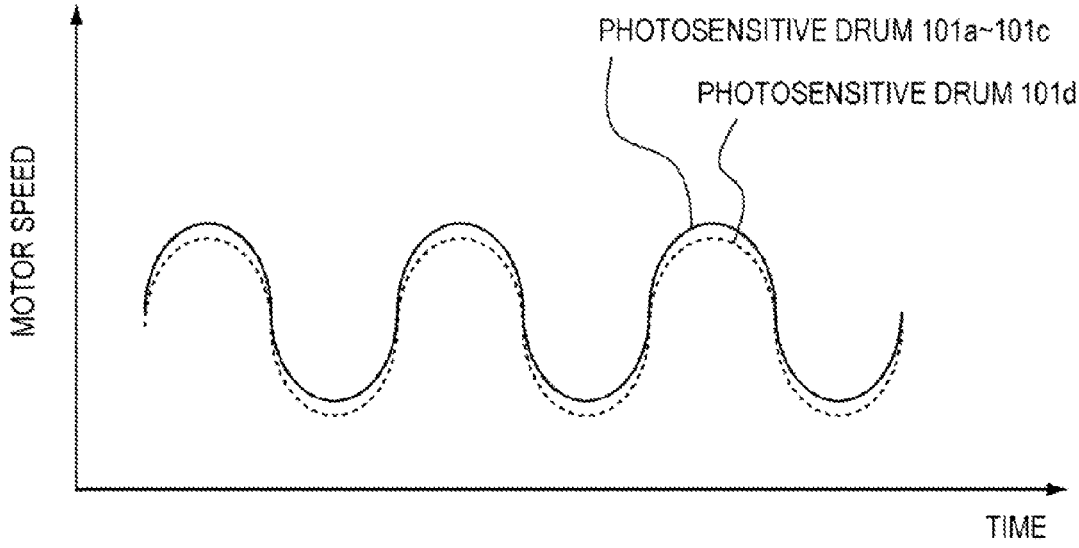

Specifically, as shown in FIG. 3B, if the phase in the rotation variation of the photosensitive drums 101*a*, 101*b*, 101*c* corresponds to that of the photosensitive drum 101*d*, the color derivation due to the rotation variations is maintained at or below a certain level. However, as shown in FIG. 3A, in a case where the phases in the rotation variations in these drums are significantly deviated each time, there is a possibility of causing unexpected significant color derivation.

In a case where the black monochrome mode is performed, since the photosensitive drums 101*a*, 101*b*, 101*c* are stopped, a phase relationship with the photosensitive drum 101*d* becomes unclear, so that the extremely significant AC color deviation possibly occurs in the next image formation. Also, upon emergency shutdown in the event of jam of the recording material, the operation is suspended in a state where a phase relationship between the photosensitive drums 101*a*, 101*b*, 101*c* and the photosensitive drum 101*d* is unclear, so that the extremely significant AC color deviation possibly occurs in the next image formation.

Therefore, the following embodiment controls the phase synchronization mode to return a rotation phase relationship between the photosensitive drums 101*a*, 101*b*, 101*c* and the photosensitive drum 101*d* to a predetermined phase relationship at a time of subsequent rotation as an example of period of image non-formation.

First Embodiment

Figure 5:
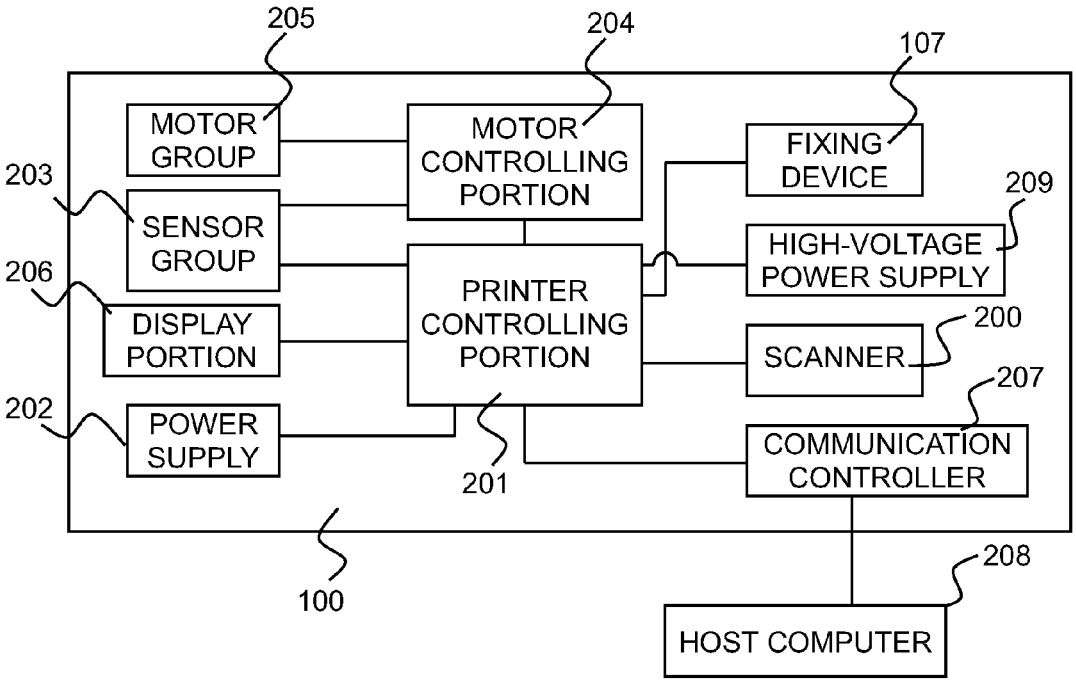
FIG. 5 is a view illustrating disposition of a phase detecting sensor.
Figure 6:
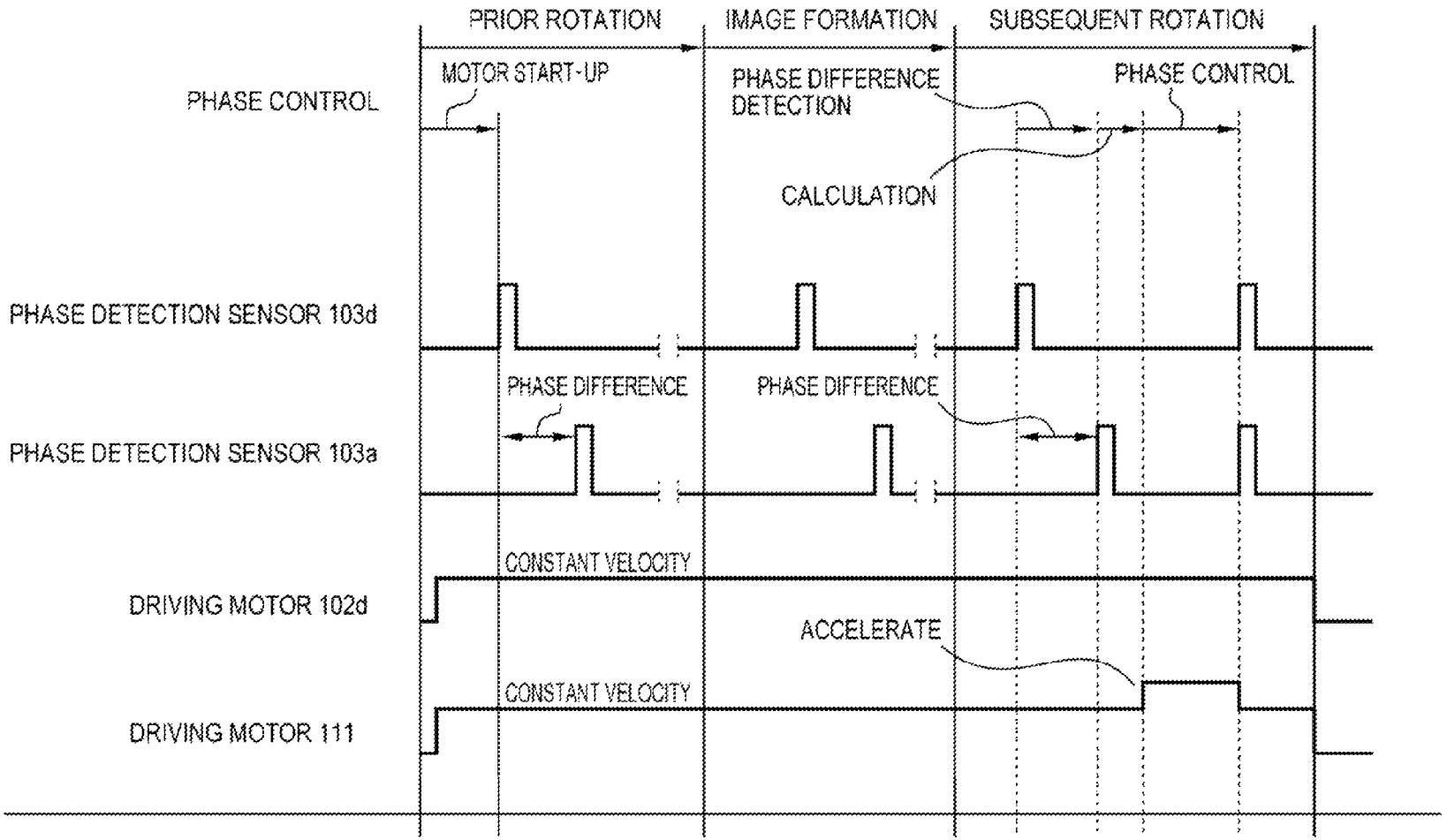
FIG. 6 is a timing diagram of control of a phase synchronization mode according to the first embodiment.

FIG. 4 is a view illustrating disposition of a phase detecting sensor. FIG. 5 is a view illustrating a configuration of a control system of the image forming apparatus. FIG. 6 is a timing diagram of control of a phase synchronization mode according to a first embodiment.

As shown in FIG. 1, the driving motor 111 is a DC brushless motor for driving the photosensitive drums 101*a*, 101*b*, 101*c*. The photosensitive drums 101*a*, 101*b*, 101*c* are assembled so as to minimize a rotation speed difference therebetween, and are driven by the common driving motor 111. The photosensitive drums 101*a*, 101*b*, 101*c* are assembled with the same phase and are driven by the common driving motor 111, thereby being always rotated with a rotation variation in the same phase.

The driving motor 102*d* is a DC brushless motor for driving the photosensitive drum 101*d*. The driving motor 102*d* also drives a developing sleeve 109*d* of the developing device 130*d* and the driving roller 105 of the intermediate transfer belt 104. On the other hand, a driving motor 110 drives developing sleeves 109*a*, 109*b*, 109*c* of the developing devices 130*a*, 130*b*, 130*c* while a driving motor 108 drives a fixing roller 107*a* of the fixing device 107.

The rotation phase of the photosensitive drum 101*a* as one of the photosensitive drums 101*a*, 101*b*, 101*c* to which a driving force is transmitted from the common driving motor 111 can be detected by a phase detecting sensor 103*a* as an example of a detecting unit. Further, the rotation phase of the photosensitive drum 101*d* to which a driving force is transmitted from the independent driving motor 102*d* can be detected by the phase detecting sensor 103*d* as an example of a detecting unit. Accordingly, a phase relationship between these drums can be detected based on the detection results of the phase detecting sensors 103*a*, 103*d*.

In the phase synchronization mode, at least one of the first driving motor 111 and the second driving motor 102*d* is controlled to adjust a phase relationship, thereby returning a phase relationship between the photosensitive drums 101*a*, 101*b*, 101*c* and the photosensitive drum 101*d* to a predetermined relationship. A motor controlling portion 204 as an example of an adjusting unit adjusts the traveling speed of the photosensitive drums 101*a*, 101*b*, 101*c* so as to set a phase relationship between the photosensitive drum 101*d* and the photosensitive drums 101*a*, 101*b*, 101*c* to a predetermined phase relationship. At a time of subsequent rotation after completion of image formation, the traveling speed is adjusted by detecting the phase relationship by means of the phase detecting sensors 103*a*, 103*d*, and thereafter the driving motors 110, 102*d* are stopped while keeping their synchronization. Either one side of the photosensitive drums 101*a*, 101*b*, 101*c* and the photosensitive drum 101*d*, which has a delayed rotation phase, is accelerated so as to be synchronized with the other side having an advanced rotation phase.

As a result, as shown in FIG. 3A, the phase relationship between the photosensitive drums 101*a*, 101*b*, 101*c* and the photosensitive drum 101*d* is returned to a predetermined phase relationship, so that the rotation speed difference between the photosensitive drums 101*a*, 101*b*, 101*c* and the intermediate transfer belt 104 is led to or below a predetermined level. However, at a time of this phase synchronization mode, the intermediate transfer belt 104 is rotated while the photosensitive drums 101*a*, 101*b*, 101*c*, 101*d* are in contact with the intermediate transfer belt 104, and thus there is a possibility of causing sliding-contact damages.

Under this circumstance, the motor controlling portion 204 as an example of a changing unit can change previously-set timing with respect to timing for starting adjustment of the traveling speed of the photosensitive drums 101*a*, 101*b*, 101*c*. Specifically, the traveling speed is adjusted subsequent to detection of the phase relationship by means of the phase detecting sensors 103*a*, 103*b*, thereby changing time from the detection of the phase relationship by the phase detecting sensors 103*a*, 103*d* to the adjustment of the traveling speed.

In this manner, a sliding-contact position on the photosensitive drums 101*a*, 101*b*, 101*c* in association with each adjustment of the traveling speed is shifted by a predetermined angle. However, the predetermined angle is selected so as not to overlap sliding-contact positions in association with each adjustment of the traveling speed, after one rotation of the photosensitive drums 101*a*, 101*b*, 101*c*, so that the sliding-contact positions are uniformly set on the entire peripheries.

FIG. 3A illustrates a state in which there is a deviation at 90-degree angle between the rotation phase of the driving motor 111 for driving the photosensitive drums 101*a*, 101*b*, 101*c* and that of the driving motor 102*d* for driving the photosensitive drum 101*d*. Therefore, the phase synchronization mode is performed to control the rotation of the driving motor 111, for example, so as to synchronize the rotation phases of the phase detecting sensor 103*a* for detecting the rotation phase of the photosensitive drum 101*a* and the phase detecting sensor 103*d* for detecting the rotation phase of the photosensitive drum 101*d*. In this manner, as shown in FIG. 3B, the rotation phase of the photosensitive drums 101*a*, 101*b*, 101*c* and that of the photosensitive drum 101*d* are in synchronization with each other, thereby returning to a state in which the AC color derivation is small.

Figure 4A:
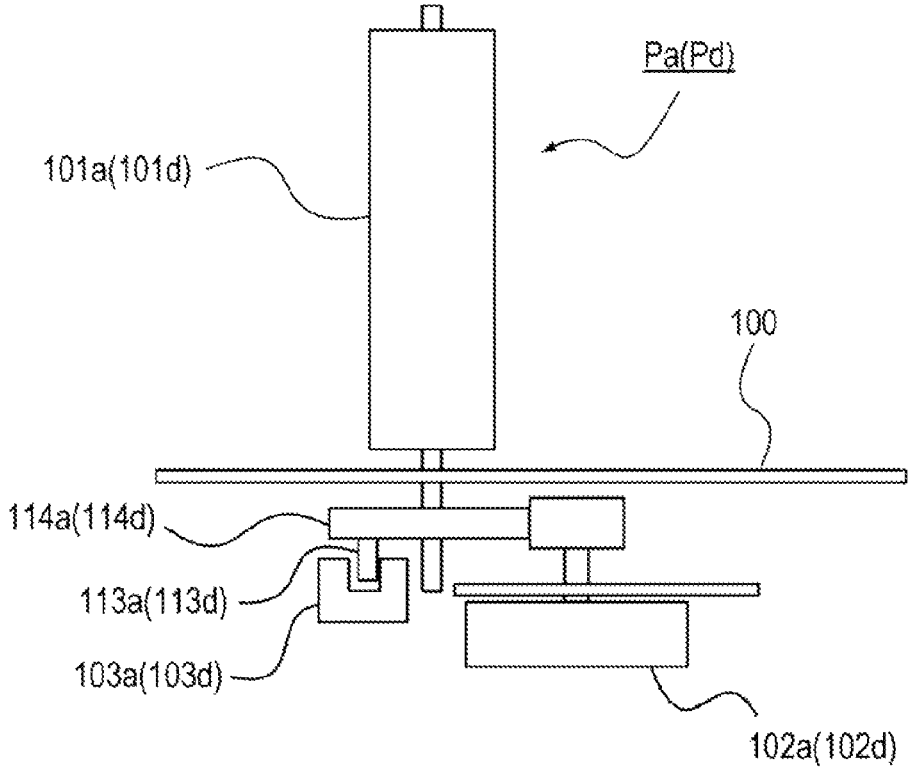
FIGS. 4A and 4B are views illustrating a configuration of a control system of the image forming apparatus.

As shown in FIG. 4A, in the phase synchronization mode, the phase detecting sensor (photo interrupter) 103*d* detects the rotation phase of the photosensitive drum 101*d*. The phase detecting sensor 103*d* detects the rotation phase of a gear 114*d* which is rotated together with the photosensitive drum 101*d* to drive it. The gear 114*d* is provided with a flag 113*d* to shield an optical path of the phase detecting sensor 103*b* in association with the rotation of the photosensitive drum 101*d*. In this manner, one flag detection signal is output per rotation of the photosensitive drum 101*d*.

Figure 4B:
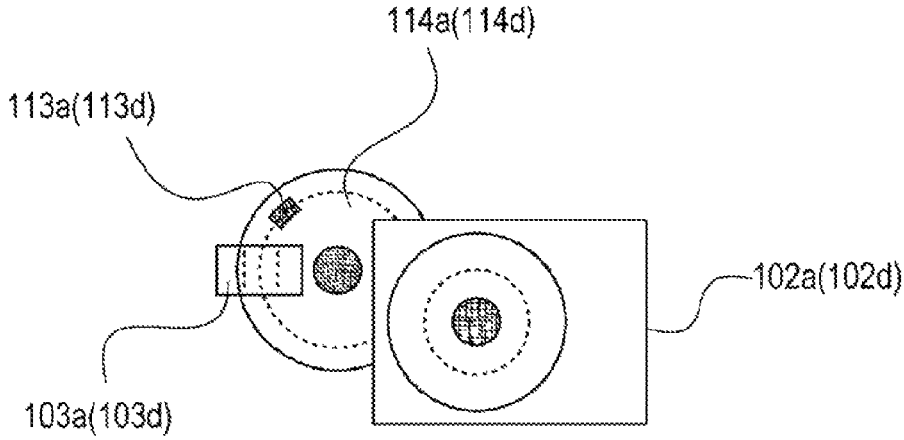

As shown in FIG. 4B, in the phase synchronization mode, the phase detecting sensor 103*a* detects the rotation phase of the photosensitive drum 101*a*. The phase detecting sensor 103*a* detects with the phase detecting sensor 103*a* the rotation phase of the gear 114*a* which is rotated together with the photosensitive drum 101*a* to drive it with the phase detecting sensor 103*a*. Upon detection of a flag 113*a* provided to the gear 114*a*, one flag detection signal is output per rotation of the photosensitive drum 101*a*.

As shown in FIG. 5, a printer controlling portion 201 controls respective devices inside the image forming apparatus 100. A power supply 202 supplies power to the respective devices. A display portion 206 informs a user of an operation state of the image forming apparatus 100. A communication controlling portion 207 performs communication between the printer controlling portion 201 and a host computer 208. The host computer 208 transfers data concerning a printing job to the image forming apparatus 100.

As shown in FIG. 5, a motor group 205 is a driving source of the respective devices inside the image forming apparatus 100 and includes the driving motor 111 for driving the photosensitive drums 101*a*, 101*b*, 101*c*, the photosensitive drum 101*d*, and the intermediate transfer belt 104. A sensor group 203 detects a condition of each device inside the image forming apparatus 100 and includes the phase detecting sensors 103*a*, 103*d* for detecting the rotation phase of the photosensitive drums 101*a*, 101*d*.

The motor controlling portion 204 is mounted with a high-speed arithmetic processing circuit such as DSP, ASIC, or CPU. The high-speed arithmetic processing circuit performs phase-switching control by a rotor-position signal from the DC brushless motor, and motor-starting control and motor-stopping control by a control signal from the printer controlling portion 201. The high-speed arithmetic processing circuit also performs speed control using a driver, based on comparison between a speed signal from the printer controlling portion 201 and output from the speed detecting sensor.

As shown in FIG. 6 with reference to FIG. 1, a first printing time (start-up waiting time) is reduced by shortening prior rotation before image formation, so that the phase synchronization mode is performed at a time of not the prior rotation but the subsequent rotation subsequent to completion of an image formation job. FIG. 6 shows timing from detection of a phase difference between the driving motors 111, 102*d* to performance of the phase control, in which the driving motor 111 drives the photosensitive drums 101*a*, 101*b*, 101*c* and the driving motor 102*d* drives the photosensitive drum 101*d*.

The phase deviation between the photosensitive drums 101*a*, 101*d* is caused mainly when starting up rotation of the photosensitive drums 101*a*, 101*b*, 101*c*, 101*d*. A rotation phase difference is generated between the driving motors 111, 102*d* when starting up rotation of the photosensitive drums 101*a*, 101*b*, 101*c*, 101*d*. A rotation phase difference is generated between the photosensitive drums 101*a*, 101*d*, depending on torque determined by the photosensitive drums 101*a*, 101*b*, 101*c*, 101*d* or the intermediate transfer belt 104 and performance unique to the motor.

On the other hand, a state of the rotation phase difference generated at a time of rotation start-up of the photosensitive drums 101*a*, 101*b*, 101*c*, 101*d* is maintained and hardly changed when successive image formation is performed after image formation is started. Since the amount of rotation phase deviation generated in the photosensitive drums 101*a*, 101*d* in association with one rotation start-up, even if the phase control is performed at a time of subsequent rotation, the next image formation job can enjoy sufficiently the advantage of phase synchronization mode.

In the phase synchronization mode, detection of a rotation phase difference (phase difference detection) and synchronization of rotation phase (phase control) are successively executed at a time of subsequent rotation after completion of the image formation job. When the subsequent rotation starts, the phase synchronization mode is started. Based on the photosensitive drum 101*d* having an advanced phase, the motor controlling portion 204 detects a rotation phase difference of the photosensitive drum 101*d* having a delayed phase and from the detection result, calculates a rotation speed and a rotation time of the driving motor 111 required to synchronize a rotation phase. After calculation, the driving motor 111 is accelerated based on the driving motor 102*d*, thereby synchronizing a rotation phase. The rotation phases of the photosensitive drums 101*a*, 101*b*, 101*c* are synchronized based on the rotation phase of the photosensitive drum 101*d* driven to rotate by the driving motor 102*d*.

It is noted that in the first embodiment, either one of the driving motors having a relatively delayed rotation phase is accelerated to synchronize its rotation phase with that of the other driving motor having an advanced rotation phase. Herein, there is another way for synchronization, in which one of the driving motors having a relatively advanced rotation phase is decelerated to synchronize its rotation phase with that of the other driving motor. However, a control time may be increased in this way. For example, in a case where the driving motor 102*d* is decelerated, a brake acts on the driving motor 111 due to friction between the intermediate transfer belt 104 and the photosensitive drum 101*a*, thereby putting heavy load on the driving motor 111. If heavy load is put on the driving motor 111 as a criterion side, it takes time to stabilize the speed of the driving motor 111, thereby increasing a total time required for the phase control.

In the first embodiment, the phase synchronization mode is certainly performed at every subsequent rotation. However, the similar phase synchronization mode may be performed at a time of the prior rotation before image formation. The image formation may be suspended to process the interrupt for the phase synchronization mode every time a predetermined number of formed images (for example, 1000 images) are accumulated. The phase synchronization mode may be performed at every other subsequent rotation or at subsequent rotation after formation of images more than the predetermined numbers.

Further, the detecting unit may be configured so that a flag is formed to the photosensitive drum 101*d* or a shaft integrated therewith so as to provide light shielding to a photosensor. The detecting unit may be configured so that a plurality of flags having different widths are provided to output a plurality of flag detection signals each having a different length per rotation of the photosensitive drum 101*a*.

<Shifting Control of Rotation Phase Synchronization Position>

Figure 7A:
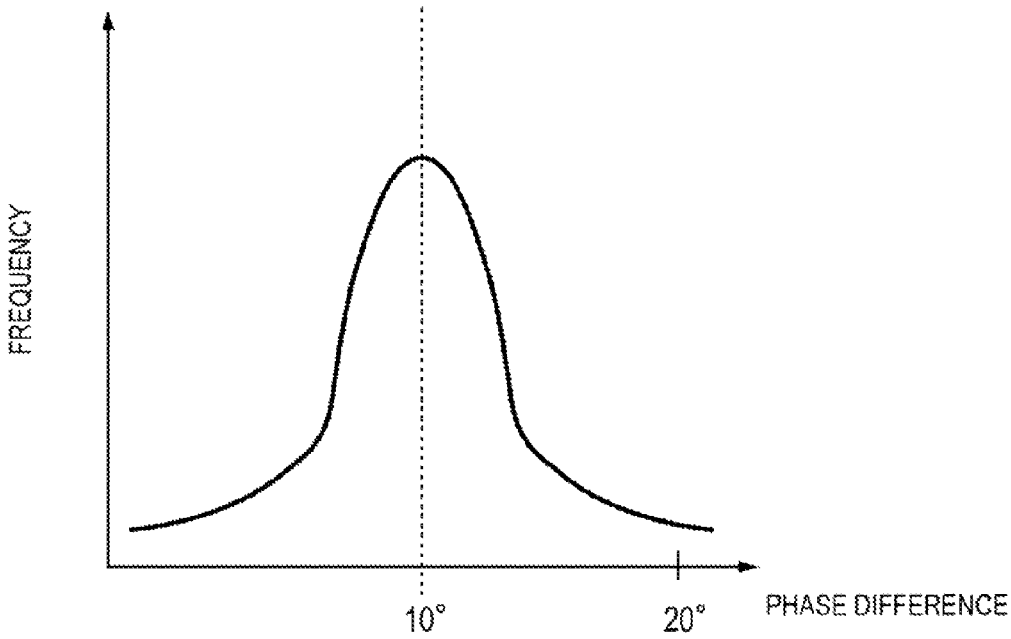
FIGS. 7A and 7B are views illustrating a rotation phase difference generated per start-up operation.
Figure 8A:
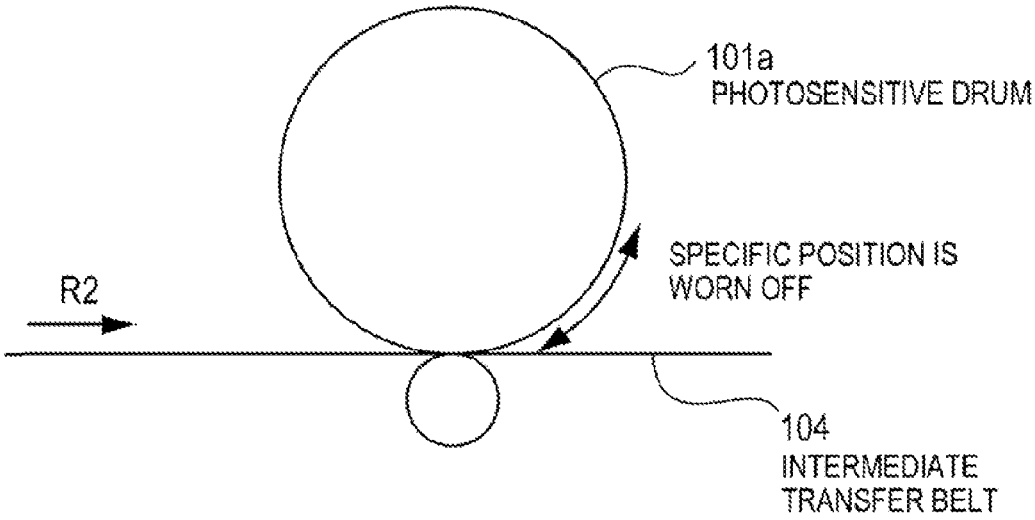
FIGS. 8A and 8B are views illustrating biased friction of the photosensitive drum.
Figure 9:
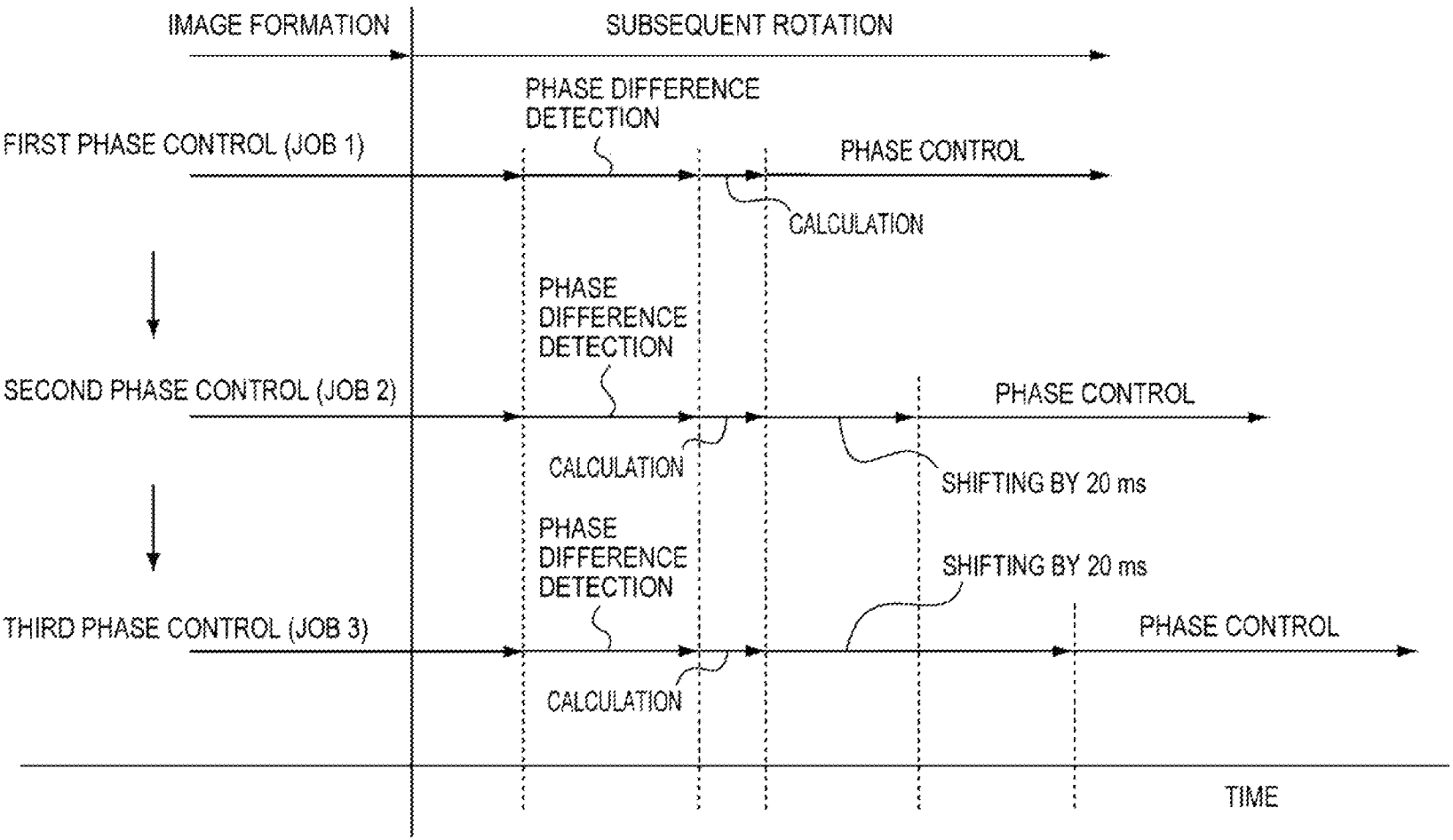
FIG. 9 is a view illustrating changes in a time chart of every phase synchronization mode.
Figure 10:
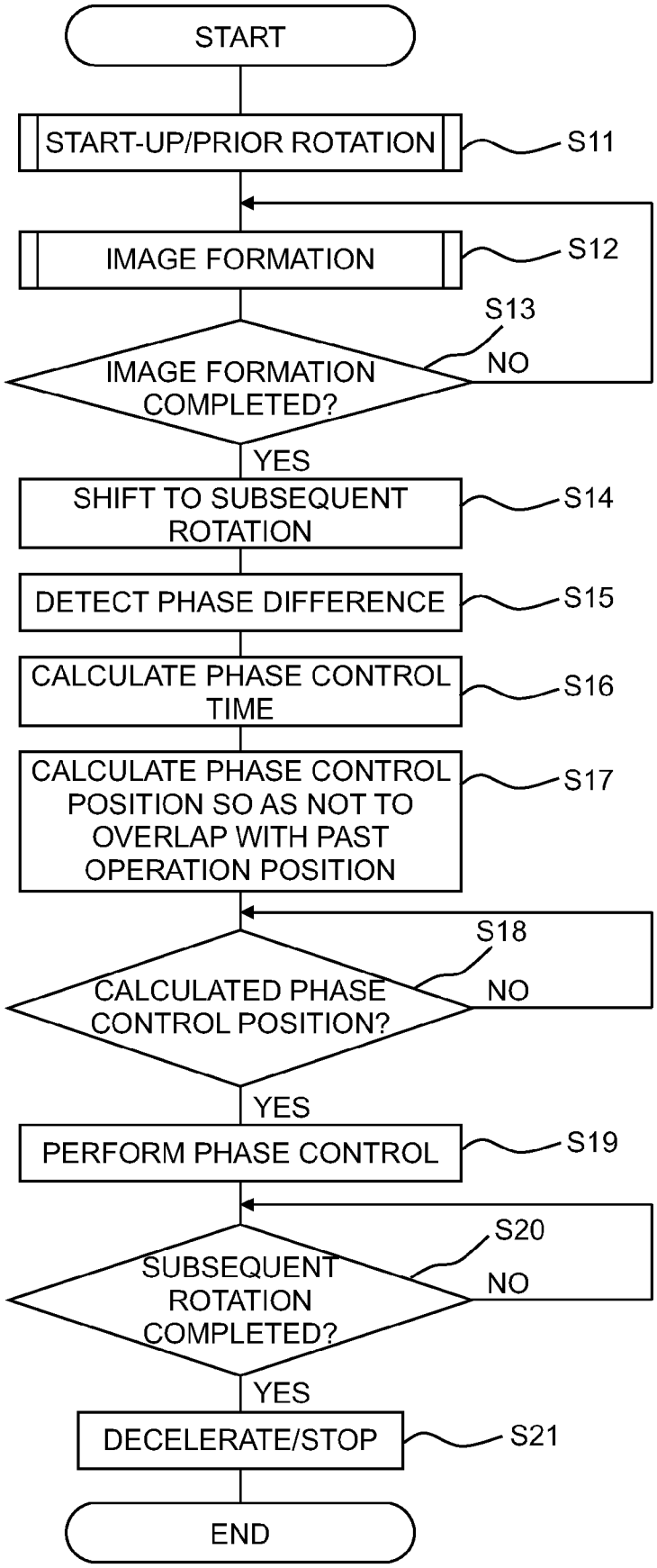
FIG. 10 is a flowchart of control of shifting a synchronization position of a rotation phase.

FIG. 7 is a view illustrating a rotation phase difference generated in association with one start-up operation. FIG. 8 is a view illustrating biased friction of the photosensitive drum. FIG. 9 is a view illustrating changes in a time chart of every phase synchronization mode. FIG. 10 is a flowchart of control of shifting a synchronization position of a rotation phase.

In the phase synchronization mode shown in FIG. 6, there is a possibility that the timing from phase detection to phase control start is always repeated at the same timing for synchronization of the rotation phases of the photosensitive drums 101*a*, 101*d*. Therefore, the rotation phase synchronization between the driving motors 111, 102*d* may be repeatedly performed at the specific positions on the photosensitive drums 101*a*, 101*d*.

The phase detecting sensors 103*a*, 103*d* are mounted on part of the gear which is rotated in synchronization with the photosensitive drums 101*a*, 101*d*. Therefore, after a position of the gear is read, in a case where the rotation phase synchronization between the driving motors 111, 102*d* is started after a certain time including a soft computing time, a phase position results in the same on the periphery of the photosensitive drums 101*a*, 101*d*.

Further, in the image forming apparatus 100, a rotation phase difference generated at a time of rotation start-up of the photosensitive drums 101*a*, 101*b*, 101*c*, 101*d* is determined depending on the photosensitive drums, the intermediate transfer belt, and the two driving motors. Accordingly, a rotation phase difference generated at a time of one rotation start-up has the Gaussian distribution with a center value. This means that a time required to detect a rotation phase difference shown in FIG. 6 also has the similar distribution.

Given that a soft computing time for performing feedback of the detection result of a rotation phase difference to the phase control is constant, a time from the phase detection to the phase control start hardly changes. This means that the phase control is always started from a predetermined position (angle) on the periphery of the photosensitive drums 101*a*, 101*b*, 101*c*, at which friction is caused on the intermediate transfer belt 104. This also means that sliding contact between the photosensitive drums 101*a*, 101*b*, 101*c* and the intermediate transfer belt 104 is concentrated on the specific position on the photosensitive drums 101*a*, 101*b*, 101*c*. When friction is caused between the photosensitive drums 101*a*, 101*b*, 101*c* and the intermediate transfer belt 104, if carriers, paper powders, or fluffs intervene in a nip portion between the drums and belt, surfaces of the photosensitive drums 101*a*, 101*b*, 101*c* are damaged.

Herein, it is assumed that the photosensitive drums 101*a*, 101*b*, 101*c*, 101*d* have a diameter of 30 mm, processing speed of 140 mm/sec, and a rotation phase difference from the photosensitive drum 101*d* detected as 10 degrees.

Figure 7B:
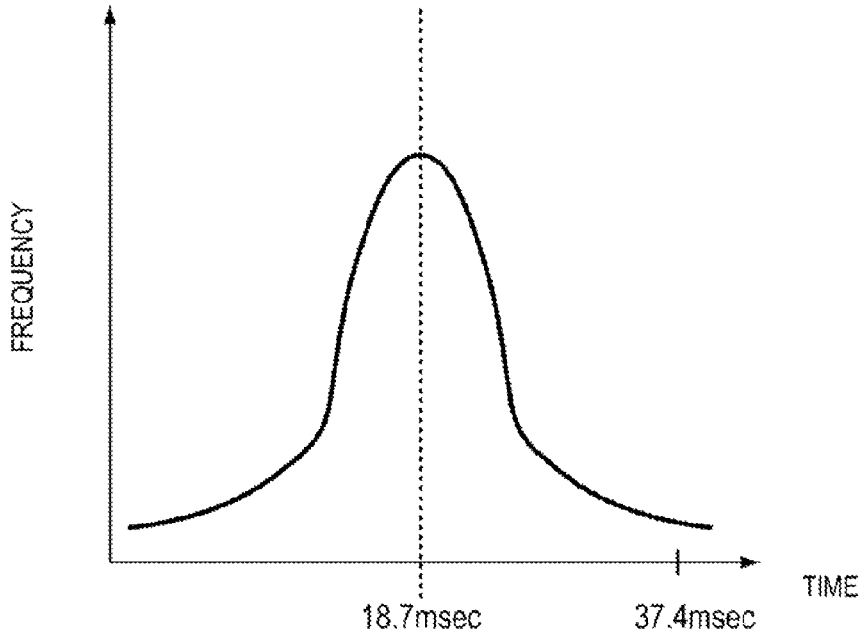

In such a case, as shown in FIG. 7B, a time required to detect a rotation phase difference results in the Gaussian distribution having a center value of 18.7 msec. At this time, a duration time of an accelerated state required to compensate a rotation phase difference by accelerating the driving motor 111 to 120% of constant speed, that is, a phase control time is approximately 100 msec. Each of the photosensitive drums 101*a*, 101*b*, 101*c* is rotated by one-seventh of the periphery within 100 msec, so that a friction region in which the photosensitive drums 101*a*, 101*b*, 101*c* come in contact with the intermediate transfer belt 104 is approximately one-seventh of the entire periphery of each photosensitive drum.

Therefore, when the phase synchronization mode is performed to repeat generation of sliding contact every time the image forming apparatus 100 is started up or stopped, damages on the photosensitive drums 101*a*, 101*b*, 101*c* appear prominently in a biased manner on one-seventh of the entire periphery of each of the photosensitive drums 101*a*, 101*b*, 101*c*. As shown in FIG. 8*a*, the specific position on the photosensitive drum causes friction with the intermediate transfer belt, thereby accelerating deterioration in association with accumulation of image formation.

Therefore, the controlling units (201, 204) start the rotation phase synchronization for the driving motors (111, 102*d*) after a lapse of a variable time subsequent to detection of a phase difference by the detecting units (103*a*, 103*d*). More specifically, timing for starting the rotation phase synchronization is shifted by 20 msec each time so as to vary angular positions of the photosensitive drums 101*a*, 101*b*, 101*c*, at which the phase control is started.

As shown in FIG. 7 with reference to FIG. 1, the next phase synchronization mode has a time from the phase difference detection to the phase control start, which is made different from a time in the previous phase mode. In comparison to the first phase synchronization mode, the second phase synchronization mode starts the phase control 20 msec behind and the third phase synchronization mode starts the phase control 20 msec more behind. It is noted that when the preset delay of time from the phase difference detection to the phase control start reaches 100 msec, the delay time is reset to start the phase control in a condition with no delay.

The timing for starting the phase control is shifted by 20 msec so as to prevent damage development and concentration by distributing sliding-contact positions on the photosensitive drums 101*a*, 101*b*, 101*c*. The sliding-contact positions between the photosensitive drums 101*a*, 101*b*, 101*c* and the intermediate transfer belt 104 are controlled to prevent friction from always occurring at the same position on the photosensitive drums 101*a*, 101*b*, 101*c*.

Figure 8B:
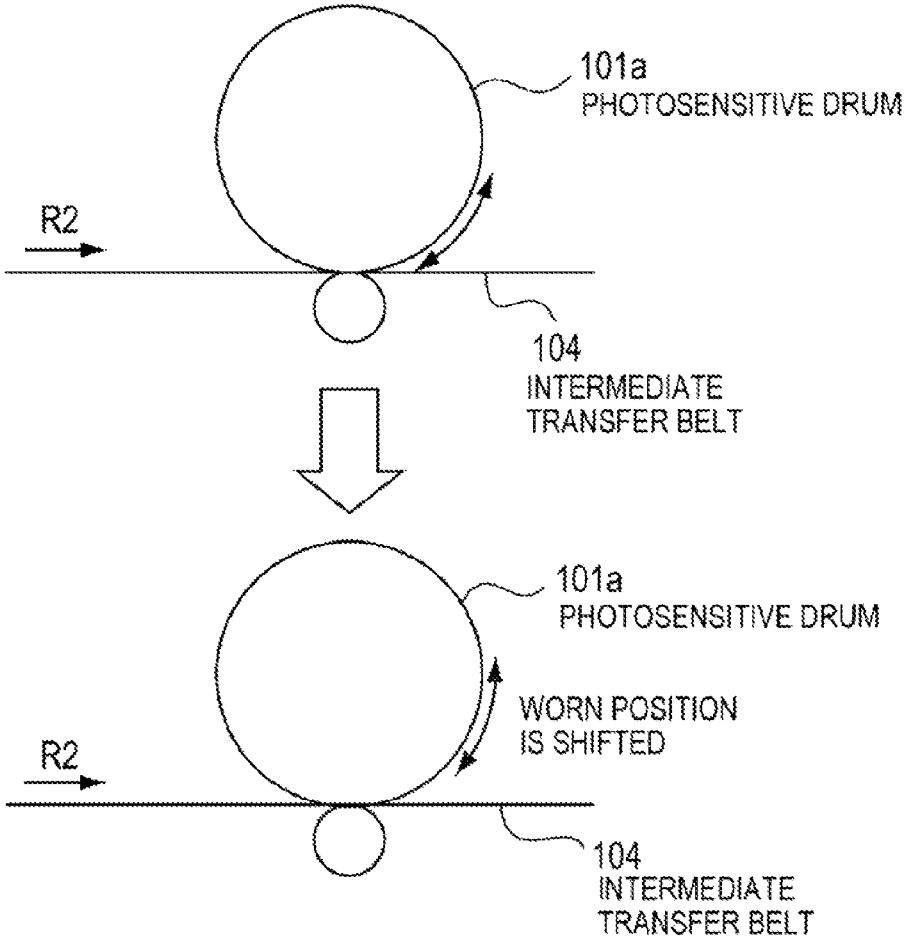

As shown in FIG. 8B, deterioration in association with accumulation of image formation is distributed on the photosensitive drums 101*a*, 101*b*, 101*c*, by shifting timing from the phase difference detection to the phase control start. The control is performed so as to prevent friction from occurring to wear or to prevent concentration of damages at the same positions on the outer periphery of the photosensitive drums 101*a*, 101*b*, 101*c*. Herein, timing to be shifted is from the phase difference detection to the phase control start but may be from start of the phase difference detecting operation to the phase control start.

As shown in FIG. 10 with reference to FIG. 1, upon receipt of the image formation job, the printer controlling portion 201 controls the motor controlling portion 204 to start up and rotate the photosensitive drums 101*a*, 101*b*, 101*c*, 101*d* and the intermediate transfer belt 104 in a forward direction (S11). Thereafter, the printer controlling portion 201 performs image formation (S12) and when completing the last image formation (YES in S13), the rotation state is shifted to the subsequent rotation (S14). The printer controlling portion 201 detects a phase difference based on the detection results by the phase detecting sensors 103*a*, 103*d* (S15), thereby calculating a phase difference control time for synchronization in accordance with a phase difference (S16).

The printer controlling portion 201 determines a this time's synchronization position, which does not overlap with the previous synchronization position on the periphery of the photosensitive drum 101*a* (S17). The printer controlling portion 201 recognizes a position each time, at which the photosensitive drum 101*a* is in contact with the intermediate transfer belt 104 by time count from detection of the flag by the phase detecting sensor 103*a*. The printer controlling portion 201 waits for timing to reach this time's synchronization timing (YES in S18), thereby performing synchronization of the phase control (S19).

Upon completion of all the control matters for the subsequent rotation (YES in S20), the printer controlling portion 201 decelerates and stops the photosensitive drums 101*a*, 101*b*, 101*c*, 101*d* and the intermediate transfer belt 104 (S201).

According to the control in the first embodiment, the image forming apparatus 100 for performing the phase control prevents deterioration from proceeding at the specific position on the photosensitive drum by shifting a start position of the phase control on the driving motor. Friction is caused to occur on the entire outer periphery of the photosensitive drum by distributing positions which cause friction between the photosensitive drum and the intermediate transfer belt.

Second Embodiment

With the image forming apparatus such as a DC charging system, an AC charging system with small discharging current, and a cleanerless system, in which the photosensitive drum has a small wear amount, there is a tendency that damages affect life of the photosensitive drum, thereby interfering with extension of the life. In comparison to the AC charging system with a large discharging current and the cleaning blade system, the speed of wearing off a surface is higher and the recovery effect on damages due to friction is small.

Table 1 shows comparison results of the advantageous effects of the present invention among the image forming apparatuses of the DC charging system with a small wear amount of the photosensitive drum, the AC charging system with a small discharging current, and the cleanerless system.

TABLE 1

| | Conventional Example | | First Embodiment | |
|---|---|---|---|---|
| | Damage Level (10K Images) | Life | Damage Level (10K Images) | Life |
| Cleaner Configuration (DC Charging) | 1.2 μm | 25K | 0.8 μm | 37.5K |
| Cleaner Configuration (Low AC Charging) | 1.0 μm | 30K | 0.6 μm | 50K |
| Cleanerless Configuration | 1.0 μm | 30K | 0.6 μm | 50K |

As shown in Table 1, even the image forming apparatus having the photosensitive drum with a small wear amount can reduce damage development on the photosensitive drum in association with accumulation of image formation under the control of the first embodiment, so that life of the photosensitive drum can be extended like the image forming apparatus 100 in FIG. 1.

Third Embodiment

A way to determine "a phase control position not overlapping with the previous operation position" shown by S17 of a flowchart in FIG. 10 is not limited to a method that timing for starting the phase control described above is set to "the previous timing +20 msec". For example, the following methods may be employed.

(1) Timing for starting the phase control is distributed around the entire periphery of the photosensitive drum 101*a* by time count from detection of the flag by the phase detecting sensor 103*a*.

(2) A rotation angle of the photosensitive drum 101*a* from detection of the flag by the phase detecting sensor 103*a* is shifted by 35 degrees each time so as to avoid overlap with the initial position after one rotation.

(3) A phase control position is recorded each time and a phase position not corresponding to the recorded position is used for the next phase control. After no more phase position which does not correspond is found, the phase position which has corresponded at the earliest time is used for the next phase control.

Between the previous synchronization and the next synchronization, the image forming apparatus according to the present invention shifts a position at which friction is actually caused between the first image bearing member and the rotating member to perform the adjustment that a rotation phase is changed in the first image bearing member and the second image bearing member each of which has a different driving motor. In this manner, the image forming apparatus prevents friction positions between the image bearing member and the rotating member from overlapping with each other in a biased manner at one part of the first or second image bearing member. It is preferable to distribute friction positions on the outer periphery of the first image bearing member. Even in a case where the traveling speed is adjusted at the next position after the traveling speed is repeatedly adjusted multiple times at the same position, the present invention can be adopted for the operation between the last time of the multiple times and the next time.

Accordingly, positions at which the traveling speed is adjusted are distributed on the entire periphery of the first or second image bearing member, so that friction and sliding-contact damages are not concentrated on one part. In a case the where adjustment is performed so that a rotation phase is changed between the first and second image baring members which are brought in contact with the common rotating member and have different driving motors, friction is prevented from proceeding or generation of many sliding-contact damages is prevented at the specific position on the periphery of the first or second image bearing member. As a result, variations in concentration or image damages in the output image due to the above can be prevented from prominently appearing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-273188, filed Dec. 1, 2009, which is hereby incorporated by reference herein in its entirety.

What is claimed is:

1. An image forming apparatus comprising:

a first image bearing member;

a second image bearing member;

a rotating member which is rotated by coming in contact with the first image bearing member and the second image bearing member;

a first driving motor which transmits a driving force to the first image bearing member;

a second driving motor which transmits a driving force to the second image bearing member;

a detecting unit which performs a detection of a phase relationship of rotation of the first image bearing member with respect to rotation of the second image bearing member;

an adjusting unit which performs an adjustment of a traveling speed subsequently to the detection of the phase relationship, and performs an adjustment of the phase relationship by changing a traveling speed of at least one image bearing member of the first image bearing member and the second image bearing member so as to set the phase relationship to a predetermined phase relationship; and a changing unit which changes a predetermined time from a start of the detection of the phase relationship by the detecting unit to a start of the adjustment of the traveling speed of the at least one image bearing member.

2. The image forming apparatus according to claim 1, wherein the adjusting unit accelerates the traveling speed of the at least one of the first image bearing member and the second image bearing member which has a delayed rotation phase so that a rotation phase of the at least one image bearing member is synchronized with a rotation phase of the other image bearing member of the first image bearing member and the second image bearing member which has a leading rotation phase.

3. The image forming apparatus according to claim 1, wherein the detecting unit detects the phase relationship by detecting a detected portion on each of the first image bearing member and the second image bearing member disposed at a specific portion in rotational directions of the first image bearing member and the second image bearing member, respectively.

4. The image forming apparatus according to claim 1, wherein the image forming apparatus performs in a phase synchronization mode in a predetermined period, in which the detecting unit performs the detection of the phase relationship, the adjusting unit performs the adjustment of the traveling speed and performs the adjustment of the phase relationship, and the changing unit changes the predetermined time, and wherein the predetermined period occurs between when the rotating member starts and when the rotating member stops and occurs when the rotating member contacts with the first image bearing member and the second image bearing member.

5. The image forming apparatus according to claim 4, wherein the predetermined period occurs when an image forming process is not performed by both the first image bearing member and the second image bearing member.

6. The image forming apparatus according to claim 4, wherein the predetermined period occurs when an image forming process is finished.

7. The image forming apparatus according to claim 6, wherein after the phase synchronization mode is performed, the first driving motor and the second driving motor are stopped.

8. The image forming apparatus according to claim 4, wherein the phase synchronization mode is performed once at least every rotation process which begins when the rotating member starts rotation and which ends when the rotating member stops rotation.

9. The image forming apparatus according to claim 4, wherein the predetermined time is increased by a predetermined additional shift time for every performance of the phase synchronization mode.

10. The image forming apparatus according to claim 4, further comprising a memory to memorize a value corresponding to the predetermined time at each performing of the phase synchronization mode, wherein the predetermined time of a next performing of the phase synchronization mode is decided as a different value from the value corresponding to the predetermined time memorized in the memory.

11. The image forming apparatus according to claim 4, wherein a sliding-contact position of the first image bearing member with respect to the rotating member at performing of the phase synchronization mode is done by shifting in a predetermined angle at each performing of the phase synchronization mode, where the predetermined angle is decided to prevent the sliding-contact position from returning to the same position of the first image bearing member after refraining a shift of the sliding-contact position.

* * * * *